US007180033B2

(12) United States Patent
Morgandi

(10) Patent No.: US 7,180,033 B2
(45) Date of Patent: Feb. 20, 2007

(54) ELECTRIC BLANKET/PAD

(75) Inventor: Arturo Morgandi, Azzano San Paolo (IT)

(73) Assignee: Imetec SpA (IT)

( * ) Notice: Subject to any disclaimer, the term of this patent is extended or adjusted under 35 U.S.C. 154(b) by 0 days.

(21) Appl. No.: 11/294,041

(22) Filed: Dec. 5, 2005

(65) Prior Publication Data

US 2006/0138117 A1 Jun. 29, 2006

(30) Foreign Application Priority Data

Dec. 7, 2004 (GB) ..... 0426799.3

(51) Int. Cl.
*H05B 1/00* (2006.01)

(52) U.S. Cl. ..... 219/212; 219/528; 219/497; 219/542; 219/549

(58) Field of Classification Search ..... 219/212, 219/528, 501, 505, 542, 544, 546, 549, 497
See application file for complete search history.

(56) References Cited

U.S. PATENT DOCUMENTS 3,222,497 A * 12/1965 Gordon, Jr. ..... 219/212
3,270,184 A * 8/1966 Negromanti ..... 219/501
3,814,899 A * 6/1974 Gordon et al. ..... 219/212
4,436,986 A * 3/1984 Carlson ..... 219/505
4,617,454 A * 10/1986 Greenhalgh ..... 219/505
5,403,992 A * 4/1995 Cole ..... 219/528
5,861,610 A * 1/1999 Weiss ..... 219/497
6,097,009 A * 8/2000 Cole ..... 219/528
6,252,198 B1 * 6/2001 Malkin ..... 219/212
6,555,787 B1 * 4/2003 Horn et al. ..... 219/212
6,737,610 B1 * 5/2004 Horn et al. ..... 219/212
6,756,572 B2 * 6/2004 Lee ..... 219/505
6,891,136 B2 * 5/2005 Bikovsky et al. ..... 219/528

* cited by examiner

*Primary Examiner*—Robin Evans
*Assistant Examiner*—Leonid M. Fastovsky
(74) *Attorney, Agent, or Firm*—Skinner and Associates

(57) ABSTRACT

An electric blanket or pad arrangement has a flexible pad (10) upon which a heating element (12) is mounted, the heating element (12) being connected, by a two core cable (16), to a control circuit (18), the heating element (12) including a dual element region (20) having a first, inner conductor (26), a second outer conductor (30), an inner insulating material layer (28) provided between the first and second conductors (26, 30), and an outer insulating material layer (32) encasing the second conductor (30), the inner insulating material layer (28) having a lower melting point than the outer insulating material layer (30), and a connecting element (22) having at least a third conductor (36) providing a series electrical connection between the first and second conductors (26, 30) at one end (12a) of the dual element region (20) of the heating element (12).

12 Claims, 3 Drawing Sheets

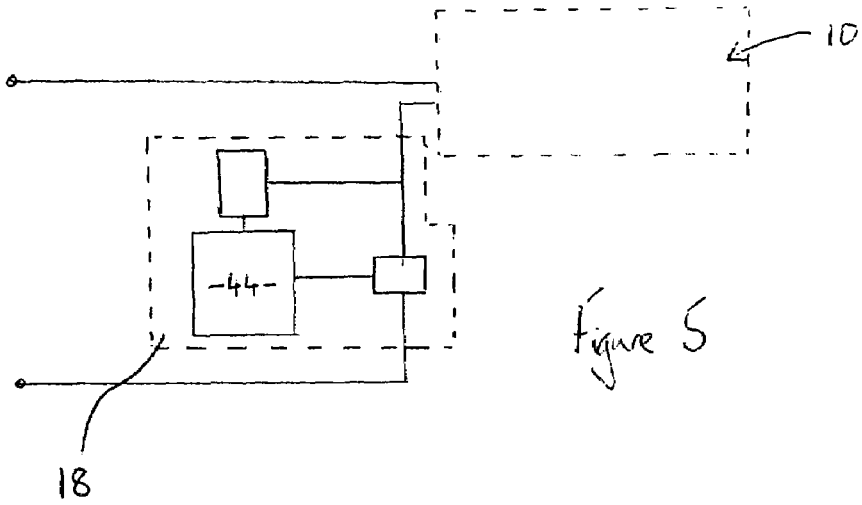
Figure 5
Figure 6
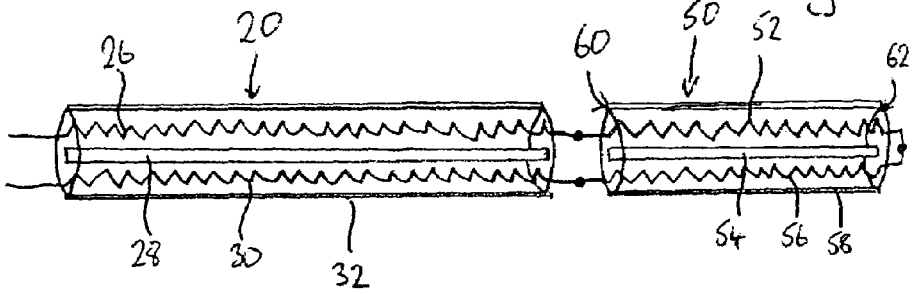
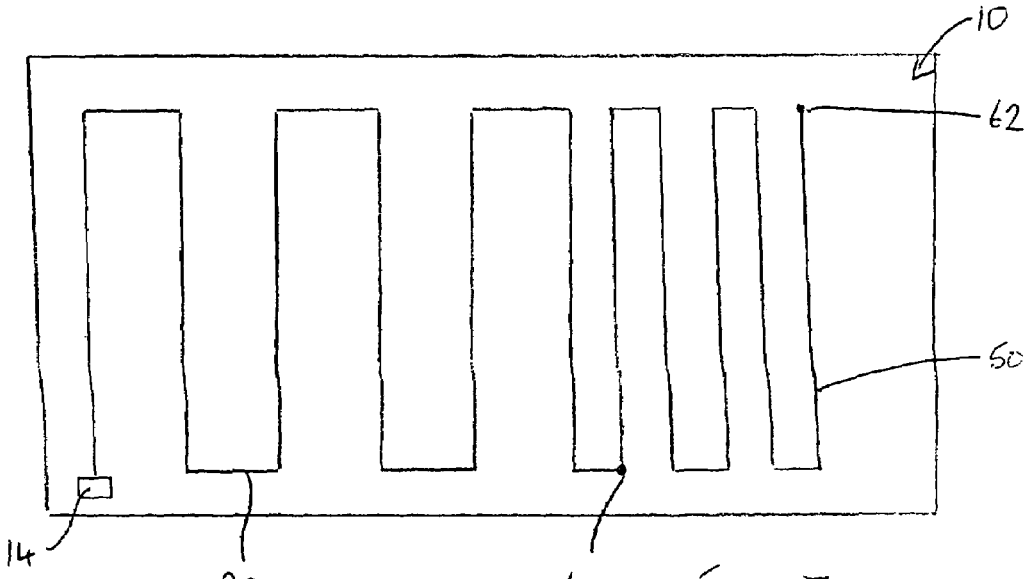
Figure 7

ELECTRIC BLANKET/PAD

This invention relates to an electric blanket or pad. In particular it relates to an electric blanket or pad having an improved, simple overheat protection capability.

One form of electric blanket having an overheat protection capability is described in EP 0910227 and includes a flexible pad upon which a heating element is located. The heating element comprises an inner element encased with an inner electrically insulating material, an outer element wound around the inner electrically insulating material, and a second, outer insulator encasing the outer element as well as the inner element and the inner electrically insulating material. The inner electrically insulating material has a significantly lower melting point than the outer insulator. At one end of the heating element the inner and outer elements are shorted together. In the event of a localised overheat condition occurring, the inner insulating material melts resulting in the inner and outer elements becoming shorted together part way along the length of the heating element. Consequently, the electrical resistance of the heating element reduces and the current flow increases. In one simple embodiment, a fuse may be arranged to blow in the event of such a rise in current, switching off the blanket. Alternatively, an electronic control circuit could be provided to monitor the current and to switch off the blanket in the event of such a rise in current.

Although a blanket of this type is advantageous in that an overheat protection capability can be provided in a simple and reliable form, overheat conditions and short circuits occurring near to the end of the heating element where the inner and outer elements are shorted to one another are difficult to sense as the increase in current occurring in the event of such a condition is only fairly small. Attempts have been made to overcome this disadvantage by ensuring that the part of heating element of relatively low sensitivity to overheat conditions is located close to a part of the element in which overheat conditions can be sensed reliably.

It is an object of the invention to provide an electric blanket or pad of improved sensitivity to over heat conditions.

According to the present invention there is provided an electric blanket or pad comprising a flexible pad upon which a heating element is mounted, the heating element being connected, by a two core cable, to a control circuit, the heating element comprising a dual element region having a first, inner conductor, a second, outer conductor, an inner insulating material layer provided between the first and second conductors, and an outer insulating material layer encasing the second conductor, the inner insulating material layer having a lower melting point than the outer insulating material layer, and a connecting element having at least a third conductor providing a series electrical connection between the first and second conductors at one end of the dual element region of the heating element.

By selection of an appropriate resistance for the third conductor, a short circuit resulting from, for example, a localised overheat condition at or close to the end of the dual element region will still result in a significant current rise as the whole of the resistance of the third conductor will be shorted. As a result, the full length or substantially the full length of the dual element region of the heating element can be used in the sensing of overheat conditions.

The connecting element may comprise a region of the heating element having a single element or conductor. The dual element region of the heating element is preferably greater in length than the single element region.

In such an arrangement, the resistance of the first, second and third conductors is conveniently chosen so that $R_3 \simeq \frac{1}{2}(R_1+R_2)$ where $R_1$, $R_2$ and $R_3$ are the resistances per unit length of the first, second and third conductors, respectively. However, other arrangements in which the power/heat output per unit length of the single element region is lower, preferably significantly lower, than that of the dual element region are also envisaged. These arrangements have the advantage that in the event of an overheat condition close to the point at which the single and dual element regions are interconnected, although the single element region may overheat, the risk of its temperature reaching that of the overheat sensitive dual element region is very low.

Although the heat output per unit length of the third conductor is preferably fairly low, the layout of the heating element on the flexible pad may be chosen to provide a close to uniform heat output per unit area over the whole of the heated area of the pad.

In an alternative arrangement, the connecting element may comprise a length of a heating element material having two conductors therein. For example, it may comprise a length of a material having an inner conductor encased within an inner insulating material, an outer conductor wound around the inner insulating material, and an outer insulating layer encasing the inner and outer conductors. The inner and outer conductors are conveniently shorted together at one end of the connecting element, the inner and outer conductors being connected, at the other end of the connecting element, to the first and second conductors.

The heat output per unit length of the connecting element is conveniently lower than that of the dual element region. In such an arrangement, in order to achieve a substantially uniform heat output per unit area of the heated part of the blanket or pad, the spacing or pitch of adjacent "runs" of the connecting element is conveniently smaller than that of the dual element region.

The inner insulating material of the connecting element preferably has a melting point higher than that of the dual element region so that, in the event of severe misuse, a short circuit is most likely to occur in the dual element region resulting in an increase in current flow of a magnitude sufficient to cause the control circuit to interrupt the power supply. For example the dual element region may be designed such that the power supply is interrupted by the control circuit in the event of the temperature reaching about 100–160° C. whereas the connecting element may be designed to operate up to temperatures of around 180–200° C.

The flexible pad may form part of, for example, an underblanket or an overblanket. However, the invention is not restricted to these applications.

The invention will further be described, by way of example only, with reference to the accompanying drawings, in which:

FIG. 5 is a block diagram, illustrating an alternative, more complex, control unit; and FIGS. 6 and 7 are diagrams illustrating an alternative embodiment.

Figure 1:
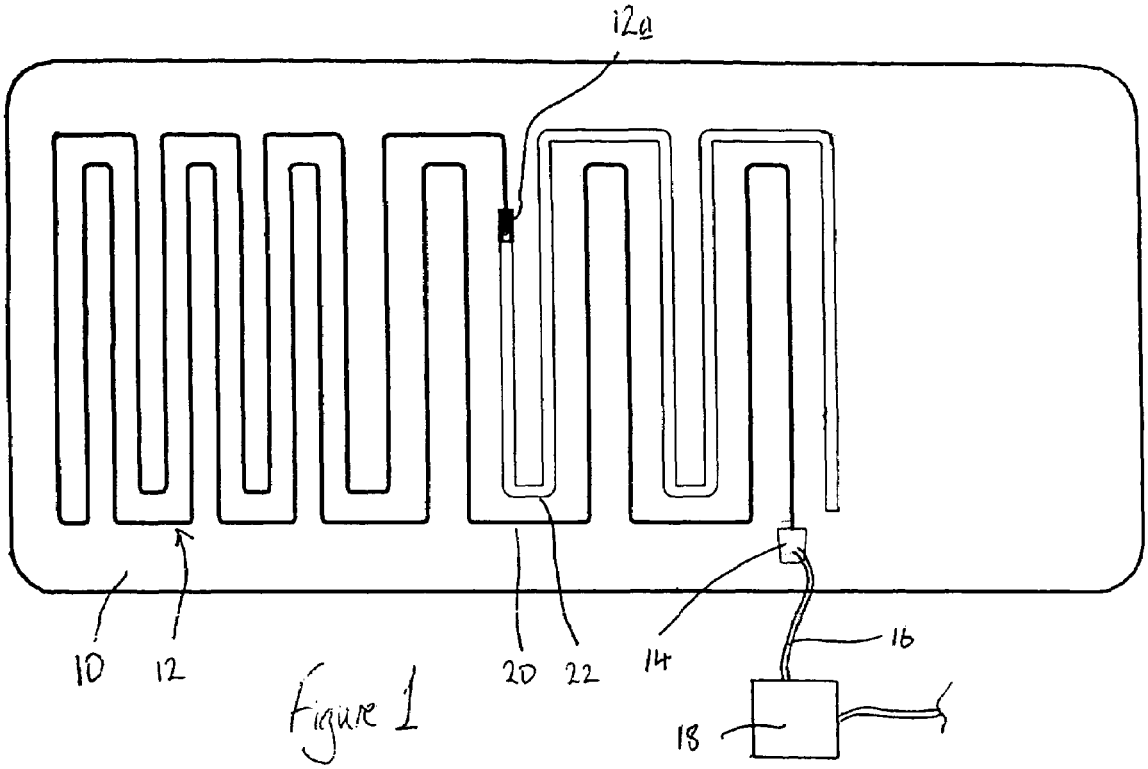
FIG. 1 is a representation illustrating an electric blanket in accordance with one embodiment of the invention.

FIG. 1 illustrates, somewhat diagrammatically, an electric blanket in accordance with one embodiment of the invention. The electric blanket of FIG. 1 comprises a pad 10 upon which a heating element 12 is mounted by being threaded through channels sewn or otherwise formed in the pad 10. No diodes or other electronic components are provided on the pad 10. One end of the heating element 12 terminates at a connector 14 whereby the heating element 12 is connected to a two core cable 16 which, in turn, is connected to a control unit 18. Although not illustrated, a suitable, conventional two pin plug and socket connector may be provided or incorporated into the two core cable 16 in order to establish a releasable electrical connection between the control unit 18 and the heating element 12. Alternatively, if desired, this function could be incorporated into the connector 14. The connector 14 may be mounted on the pad 10 or be separate therefrom, if desired.

The heating element 12 comprises a dual element region 20 illustrated in FIG. 1 by the bold lines, and a connecting element in the form of a single element region 22 denoted by the lighter lines in FIG. 1.

Figure 2:
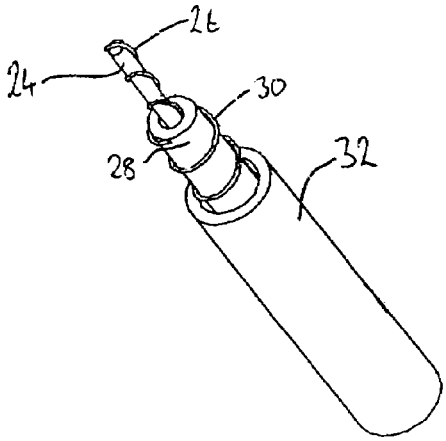
FIG. 2 is a perspective view illustrating part of one component of the blanket of FIG. 1.

The dual element region 20 of the heating element 12 is illustrated in greater detail in FIG. 2 and comprises a support 24, for example of polyester yarn. Around the support 24 is wound a first, inner conductor 26. An inner layer 28 of an electrically insulating material encases the inner conductor 26, and a second, outer conductor 30 is wound around the layer 28 of electrically insulating material. An outer layer 32 of electrically insulating material, for example of PVC, encases the second conductor 30 together with the layer 28 of electrically insulating material, the first conductor 26 and the support 24. The materials used in the dual element region 20 of the heating element 12 are chosen such that the melting point of the layer 28 of insulating material is lower than the melting point of the outer layer 32 of insulating material such that in the event of a localised overheat condition, the inner layer 28 of electrically insulating material will melt, resulting in the formation of a short circuit between the first and second conductors 26, 30, before melting of the outer layer 32 of insulating material occurs.

Figure 3:
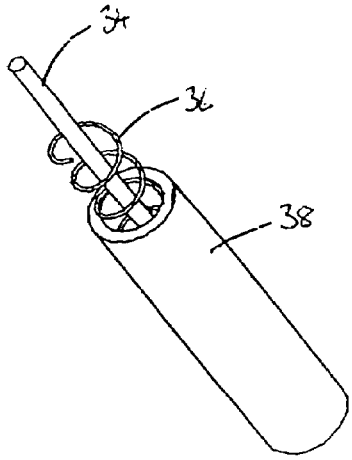
FIG. 3 is a view similar to FIG. 2 of another component.

The single element region 22 of the heating element 12 is illustrated in greater detail in FIG. 3 and comprises a support 34, for example of polyester yarn, around which a third element 36 is wound. An outer layer 38 of an electrically insulating material, for example PVC, encases the third conductor 36 and the support 34.

As shown in FIG. 1, the single element region 22 of the heating element 12 is located at the end 12*a* of the heating element 12 remote from the connector 14, the single element region of 22 of the heating element 12 being arranged such that the third conductor 36 is connected at one end of the single element region 22 to the first conductor 26 of the dual element region 20, the opposite end of the third conductor 36 being electrically connected to the second conductor 30, both of the connections between the dual element region 20 and single element region 22 of the heating element 12 occurring at the same end (End 12*a*) of the dual element region 20.

The control unit 18 is arranged to break the electrical supply in the event of an overheat condition being sensed. One form of control unit 18 includes a circuit as illustrated by the circuit diagram shown in FIG. 4.

Figure 4:
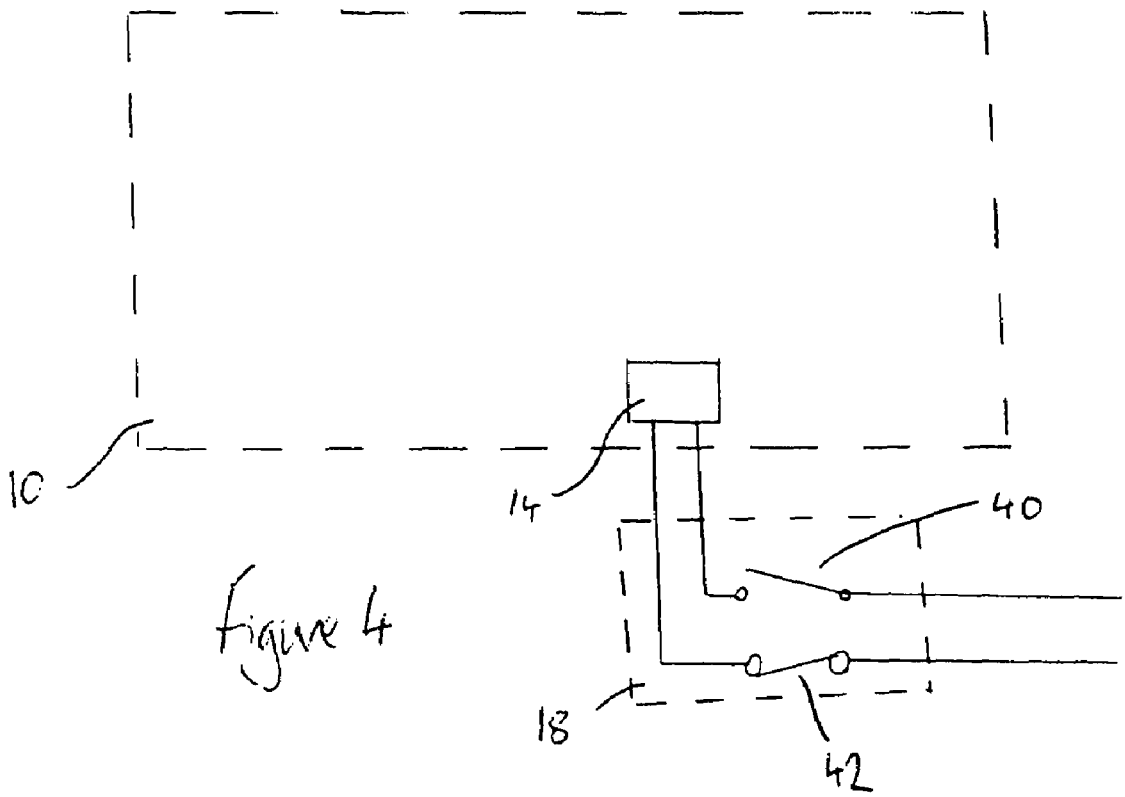
FIG. 4 is a circuit diagram illustrating one simple form of control circuit.

As shown in FIG. 4, the control unit 18 contains a switch 40 operable to switch on and off the electrical supply to the heating element 12. The switch 40 may further include means to allow the heat output of the electric blanket to be controlled. The control unit 18 further comprises a fuse device 42, for example a simple fuse link arranged to terminate the electrical supply to the heating element 12 in the event of the electrical current rising above a predetermined level.

In use, in the event of an overheat condition occurring, for example due to the blanket becoming rucked, the inner insulating material layer 28 of the part of the dual element region 20 of the heating element 12 in the region of the local overheat condition will melt with the result that a short circuit is formed between the first and second conductors 26, 30 in the region of the overheat. The formation of the short circuit between the first and second conductors 26, 30 will result in a significant reduction in the overall electrical resistance of the heating element 12 and as a result, the electrical current flowing through the heating element 12 will rise. In the event that the electrical current rises above the maximum permitted by the fuse 42, the fuse 42 will blow thereby terminating the electrical supply to the heating element 12 and rendering the blanket safe.

The provision of the third conductor 36 inter-connecting the first and second conductors 26, 30 at the end 12*a* of the dual element region 22 remote from the connector 14 ensures that even the occurrence of an overheat condition at or close to this end of the dual element region 20 results in a significant increase in the current flowing the heating element 12 thereby allowing the full or substantially the full length of the dual element region 20 to be used in the sensing of overheat conditions.

In order to ensure that substantially the full length of the dual element region 20 can be used in the sensing of overheat conditions, it is desirable for the single element region 22 to be of relatively high resistance. It is envisaged that the electrical resistance per unit length of the third conductor 36 should be approximately equal to half of the sum of the resistances per unit length of the first and second conductors 26, 30. However, the invention is not restricted to this specific arrangement and it will be appreciated that other arrangements in which the power output power unit length of the single element region is lower, preferably significantly lower, than that of the dual element region are also possible. In such arrangements, in the event of an overheat condition close to the point at which the dual element region is connected to the single element region, although the single element region 22 of the element 12 may still overheat, the risk of its temperature reaching that of the overheat protected dual element region 20 is very low.

As illustrated, the length of the dual element region 20 of the heating element is preferably significantly greater than that of the single element region 22. The proportion of the total length of the heating element 12 formed by the dual element region 20 may be dependent upon the nature of the technique used to sense a rise in electrical current flowing through the heating element 12. For example, where an electronic technique is used to monitor the electrical current, the dual element region 20 may form up to around 95% of the total length of the heating element 12. However, where a fuse 42 is used, it is envisaged that the dual element region 20 forms up to around 75% of the total length of the heating element.

Although the heat output of the single element region 22 of the heating element 12 is low compared to that of the dual element region 20, by appropriate selection of the layout of the heating element 12 on the flexible pad 10, the overall heat output per unit area of the electrically heated blanket, or at least that part of the blanket which is intended to be heated, can be substantially uniform. Clearly, therefore, the provision of an improved overheat protection arrangement need not result in the electric blanket suffering from cold spots.

The arrangement illustrated in FIG. 1 is intended for use in an electric under blanket. However, it will be appreciated that the same technology may be applied to electrically heated over blankets or other devices, if desired.

Although the fuse device 42 is illustrated a being located within the control unit 18, it will be appreciated that it could, alternatively, be located elsewhere, for example in the connector 14 or in an entirely separate housing, if desired.

The control unit 18 illustrated diagrammatically in FIG. 4 is of very simple form, relying on a fuse device blowing in the event of an over current resulting from the occurrence of an overheat condition Other more complex control arrangements may be provided if desired. For example, FIG. 5 illustrates a control unit 18 which uses an electronic microprocessor 44 to control the operation of the blanket. The control unit 18 includes components operable to allow monitoring of the current flowing through the heating element 12 of the electric blanket, and the microprocessor 44 is arranged to switch off the electrical supply to the heating element 12 in the event of the sensed current exceeding a predetermined threshold. As mentioned hereinbefore, the use of such a circuit may allow the proportion of the heating element 12 formed by the dual element region 20 to rise to about 95%, if desired.

FIGS. 6 and 7 illustrate, diagrammatically, an alternative embodiment of the invention. The arrangement of FIGS. 6 and 7 differs from that of FIG. 1 in that the connecting element takes the form of a length of a dual conductor heating element 50 rather than taking the form of a single element region.

The dual conductor heating element 50 is of structure similar to the dual element region 20 as illustrated in FIG. 2. In particular, it comprises an inner conductor 52 encased within an electrically insulating material 54, an outer conductor 56 wound around the electrically insulating material 54, and an outer, electrically insulating casing 58. The inner and/or outer conductors 52, 56 can be regarded as forming the third conductor referred to hereinbefore.

At one end, end 60, of the element 50, the inner and outer conductors 52, 56 are electrically connected to respective ones of the first and second conductors 26, 30 of the dual element region 20. At the other end, end 62, the inner and outer conductors 52, 56 are shorted or directly connected to one another.

The electrical resistances of the inner and outer conductors 52, 56 are preferably chosen, relative to the resistances of the first and second conductors 26, 30, such that the power or heat output per unit length of the dual conductor heating element 50 is lower than that of the dual element region 20. In order to maintain a substantially uniform heat output per unit area of the heated part of the blanket, the pitch or spacing of adjacent runs or passes of the dual conductor heating element 50 is preferably smaller than that of the dual element region 20.

Although other configurations are possible, in one arrangement that is envisaged the sum of the resistances of the inner and outer conductors 52, 56 is approximately equal to half of the sum of the resistances of the first and second conductors 26, 30.

The inner insulating material 54 may have a melting point higher than that of the layer 28 of the dual element region 20. As a result, in the event of severe misuse, the part of the element 12 which will overheat to a temperature sufficient to cause a short circuit is the dual element region 20, and the control circuit is designed to be sensitive to the occurrence of short circuits of the dual element region 20. By way of example, the layer 28 of the dual element region 20 may be arranged to melt and allow the formation of a short circuit at a temperature of about 100–160° C. whereas the material 54 of the dual conductor heating element 50 may be chosen to allow normal operation at temperatures up to about 180–200° C. To achieve this it is envisaged to use a suitable rubber or PVC material for the material 54.

If desired, the connecting element can be constructed to be physically stronger than the dual element region 20 so that crushing, stretching or other physical abuse of the blanket is more likely to result in damage to the dual element region 20 than the connecting element, which may be detected in the event of the damage resulting in a short circuit.

The use of a dual conductor heating element as the connecting element may result in the manufacture, particularly automated manufacture, of the blanket being simplified. It further allows the field cancelling effect of the electrical current flowing in opposite directions to be used in reducing the emission of electromagnetic radiation.

The arrangement illustrated in FIGS. 6 and 7 may be used with either form of control circuit described hereinbefore, and operation of the blanket is substantially the same as described hereinbefore with reference to FIGS. 1 to 4.

Although the description and drawings show specific examples of the invention, it will be appreciated that a range of modifications or alterations may be made thereto within the scope of the invention and this application should not be taken to be restricted to the specific arrangements shown and described. For example, if desired the connector 14 could be omitted and a fixed connection be made between the heating element and the control unit.

The invention claimed is:

1. An electric blanket or pad arrangement comprising a flexible pad upon which a heating element is mounted, the heating element being connected, by a two core cable, to a control circuit, the heating element comprising a dual element region having a first, inner conductor, a second, outer conductor, an inner insulating material layer provided between the first and second conductors, and an outer insulating material layer encasing the second conductor, the inner insulating material layer having a lower melting point than the outer insulating material layer, and a connecting element having at least a third conductor providing a series electrical connection between the first and second conductors at one end of the dual element region of the heating element.

2. An arrangement according to claim 1, wherein the connecting element comprises a region of the heating element having a single element or conductor.

3. An arrangement according to claim 1, wherein the dual element region of the heating element is greater in length than the connecting element.

4. An arrangement according to claim 1, wherein the resistance of the first, second and third conductors is chosen so that $R_3 \simeq \frac{1}{2}(R_1+R_2)$ where $R_1$, $R_2$ and $R_3$ a per unit length of the first, second and third conductors, respectively.

5. An arrangement according to claim 1, wherein the layout of the heating element on the flexible pad is chosen to provide a close to uniform heat output per unit area over the whole of the heated area of the flexible pad.

6. An arrangement according to claim 1, wherein the connecting element comprises a length of a heating element material having two conductors therein.

7. An arrangement according to claim 6, wherein the connecting element comprises a length of material having an inner conductor encased within an inner insulating material, an outer conductor wound around the inner insulating material, and an outer insulating layer encasing the inner and outer conductors.

8. An arrangement according to claim 7, wherein the inner and outer conductors are shorted together at one end of the connecting element, the inner and outer conductors being connected, at the other end of the connecting element, to the first and second conductors.

9. An arrangement according to claim 6, wherein the heat output per unit length of the connecting element is lower than that of the dual element region.

10. An arrangement according to claim 9, wherein the spacing or pitch of adjacent "runs" of the connecting element is smaller than that of the dual element region.

11. An arrangement according to claim 6, wherein the inner insulating material of the connecting element has a melting point higher than that of the dual element region.

12. An arrangement according to claim 11, wherein the dual element region is designed such that the power supply is interrupted by the control circuit in the event of the temperature reaching about 100–160° C., the connecting element being designed to operate up to temperatures of around 180–200° C.

* * * * *